United States Patent [19]

Roestenberg

[11] Patent Number: 4,680,895

[45] Date of Patent: Jul. 21, 1987

[54] BLOCK SANDER VACUUM

[76] Inventor: Jerome R. Roestenberg, 11 Woodpecker La., Levittown, N.Y. 11756

[21] Appl. No.: 902,852

[22] Filed: Sep. 2, 1986

[51] Int. Cl.[4] ..... B24B 23/00

[52] U.S. Cl. ..... 51/170 R; 51/273; 15/415 R

[58] Field of Search ..... 51/170 R, 204, 205 R, 51/273; 15/415 R

[56] References Cited

U.S. PATENT DOCUMENTS

| | | | |
|---|---|---|---|
| 2,499,933 | 3/1950 | Smul | 51/273 |
| 3,673,744 | 7/1972 | Oimoen | 51/177 |
| 3,785,092 | 1/1974 | Hutchins | 51/170 MT |
| 3,824,745 | 7/1974 | Hutchins | 51/170 T |
| 3,837,383 | 9/1974 | Ko | 51/273 |
| 3,935,678 | 2/1976 | Marton | 51/170 T |
| 4,071,981 | 2/1978 | Champayne | 51/170 MT |
| 4,135,334 | 1/1979 | Rudiger | 51/273 |
| 4,145,848 | 3/1979 | Hutchins | 51/273 |
| 4,328,645 | 5/1982 | Sauer | 51/170 T |
| 4,616,449 | 10/1986 | Marton | 51/273 |

*Primary Examiner*—Roscoe V. Parker

*Attorney, Agent, or Firm*—Nolte, Nolte and Hunter

[57] ABSTRACT

A block sander provided, in opposite lateral sides, with ports that can be connected through internal passages in the sander to a tubular coupling for the hose of a vacuum cleaner. A flexible depending skirt is mounted over each lateral side of the sander. Each skirt is spaced laterally away from the ports in its adjacent lateral side of the sander, so that dust generated by the sander can be sucked upwardly between each skirt and its adjacent lateral side of the sander into the ports and internal passages of the sander and, from there, into the vacuum cleaner, to maintain a clean and healthy working environment that is substantially free of air-borne dust.

11 Claims, 4 Drawing Figures

BLOCK SANDER VACUUM

BACKGROUND OF THE INVENTION

This invention relates to an abrading device, such as a block sander, which can be attached to a vacuum cleaner to remove dust as it is generated during use of the device.

Abrading devices provided with vacuum hoods or shields, connected to sources of vacuum which remove dust generated within the shields by the abrading devices, are well known. See, for example, U.S. Pat. Nos. 3,673,744, 3,785,092, 3,824,745, 3,837,383, 3,935,678, 4,071,981, 4,135,334, 4,145,848 and 4,328,645. Such shields have generally been quite useful for protecting the users of the abrading devices from air-borne dust generated by such devices. However, such shields have generally been rather large and cumbersome because they have been designed to substantially enclose motor-drive abrading machines, such as portable rotary sanders. Such shields have been ill-suited for use with smaller hand-powered abrading devices, such as simple block sanders.

There has been a need, therefore, for a simple and compact means for removing dust as it is generated by a hand-powered abrading device.

SUMMARY OF THE INVENTION

In accordance with this invention, a hand-powered abrading device is provided, comprising:

- a substantially rigid body having a substantially planar bottom and a plurality of ports in a lateral side thereof;
- adbrading means on the bottom of the body;
- handle means on top of the body for holding the body and moving it longitudinally to abrade an object beneath the body in contact with the abrading means;
- passage means extending laterally and longitudinally through the body and adapted to connect the ports to a source of vacuum; and
- a depending skirt connected to the body above the ports and extending longitudinally along, and adjacent to, the lateral side of the body and the ports therein; the skirt: (a) substantially covering the ports, (b) being spaced laterally away from the lateral side and its ports and (c) extending downwardly beneath the ports to at least about the bottom of the body.

This device can be connected to a conventional vacuum cleaner which will continuously remove dust as it is generated by use of the device for abrading an object.

DETAILED DESCRIPTION OF THE PREFERRED EMBODIMENT

Figure 1:
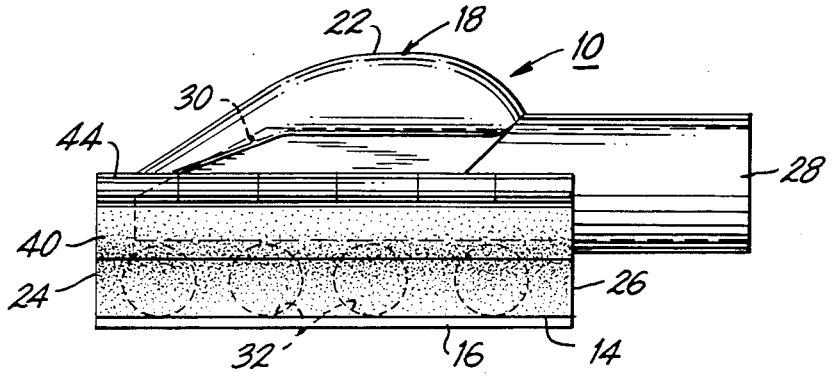
FIG. 1 is a schematic side elevation view of a block sander in accordance with this invention.
Figure 2:
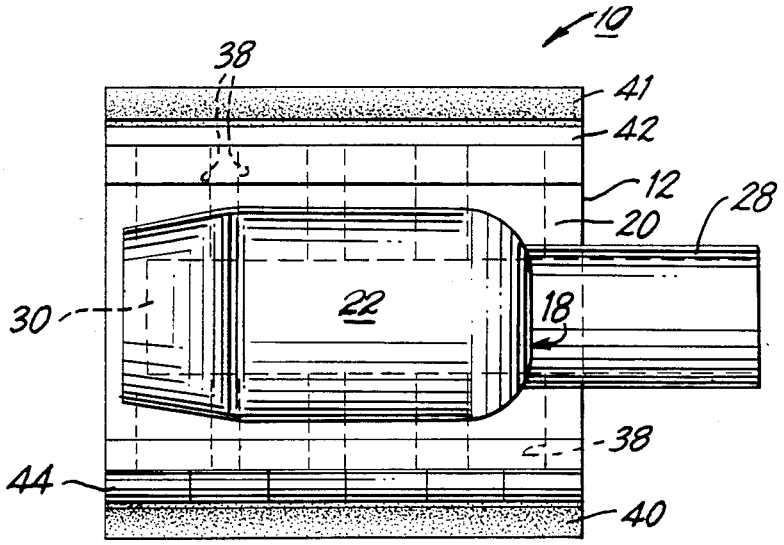
FIG. 2 is a schematic top plan view of the sander of FIG. 1.

Shown schematically in FIGS. 1–4 is a block sander of this invention, generally 10. The sander 10 is formed with a substantially rigid body or block 12 that is preferably a hexahedron. The bottom 14 of the sander body 12 is substantially planar. A conventional abrasive 16 (e.g., sandpaper) is removably (e.g., adhesively) attached to the bottom 14 of the body 12 so that the abrasive will move with the bottom 14 of the body to abrade a surface of an object against which the abrasive is urged.

A handle 18 is provided on the top 20 of the body 12 of the sander 10. The handle 18 can be used for grasping and moving the sander and pressing its abrasive 16 against the surface of the object, to be abraded. Preferably, the handle 18 is integral with the top 20 of the sander body 12, but the handle 18 can, if desired, be attached in a conventional manner (e.g., adhesively) to the top 20 of the body 12. Preferably, the handle 18 has a smooth rounded top 22 to fit comfortably in the palm of the hand of the user, and the handle extends longitudinally along the body 12 from about its front 24 to its rear 26.

At the rear 26 of the sander 10 is a conventional connector 28 for a vaccum hose (not shown) which can, in turn, be connected to a source of vacuum such as a conventional vacuum cleaner. As shown in FIGS. 1–4, the vacuum connector 28 can comprise a conventional tubular member, the rear of which is open and the front of which is in communication with a central cavity 30 (shown in phantom in FIGS. 1 and 2) within the integral handle 18 and sander body 12. If desired, the vacuum connector 28 can be formed so that it is also integral with the handle 18 and body 12. The cavity 30 preferably extends longitudinally from the vacuum connector 28 toward the front 24 of the sander body 12. The cavity 30 is connected to a plurality of ports 32 (shown in phantom in FIG. 1) in each of the opposite, preferably planar, lateral sides 34 and 36 of the sander body 12. As best shown in FIG. 4, the ports 32 are preferably circular and arranged in a longitudinally extending row in each lateral side 34 and 36. It is particularly preferred that the bottom of each port 32 be adjacent, preferably substantially tagential, to the bottom of the body 12. The ports 32 are connected to the cavity 30 by a plurality of channels 38 (shown in phantom in FIGS. 2 and 3) within the body 12 and handle 18. The channels 38 extend laterally from the cavity 30 to the ports 32 so that the ports are in air-flow communication with the vacuum connector 28.

Mounted above the ports 32 in the lateral sides 34 and 36 of the sander body 12, preferably on the top 20 of the body 12, are a pair of depending, preferably flexible, skirts 40 and 41. Each skirt 40 and 41 is adjacent to, and extends longitudinally along, one of the lateral sides 34 and 36, respectively, and the ports 32 therein from about the front 24 to the rear 26 of the sander body. Each skirt 40 and 41 also extends downwardly over all the ports 32 in its adjacent lateral side 34 and 36 of the sander body 12. The means for connecting each skirt 40 and 41 to the sander body 12 is not critical, but it is preferred that each such connection form a substantially continuous barrier to downward air flow toward the adjacent ports 32 along the longitudinal length of the adjacent lateral side 34 and 36. It is also preferred that the skirt 41 adjacent to one lateral side 36 be fixedly connected to the body 12, preferably by means of a rigid bracket 42 mounted on top of the body 12 and extending longitudinally along substantially the entire length of the adjacent lateral side 36, and that the skirt 40 adjacent the other lateral side 34 be hingedly connected to the body 12, preferably by means of a hinge 44 on top of the body extending longitudinally along substantially the entire length of the adjacent other lateral side 34. Each skirt 40 and 41 covers the ports 32 in its adjacent lateral side 34 and 36, respectively, and extends downwardly beneath its adjacent ports 32 to at least about the bottom 14 of the sander body 12 and preferably beneath the bottom 14 of the body 12 but not beneath the abrasive 16.

Figure 3:
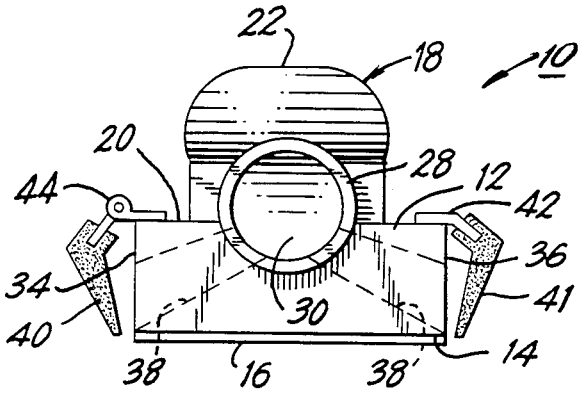
FIG. 3 is a schematic rear view of the sander of FIGS. 1 and 2.
Figure 4:
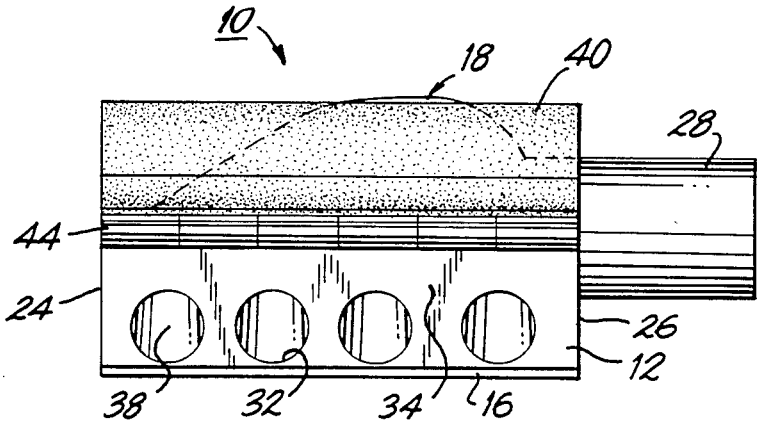
FIG. 4 is a schematic side elevation view of the sander, similar to FIG. 1, showing the skirt on one side of the sander pivoted upwardly about its hinged connection to the body of the sander.

As best shown in FIG. 3, each skirt 40 and 41 on the sander body 12, particularly the bottom of each skirt, is laterally spaced away from: its adjacent lateral side 34 and 36, respectively of the body; its adjacent lateral edge of the abrasive 16; and all the ports 32 in its adjacent lateral side 34 and 36. This lateral spacing is not critical and can suitably vary between about $\frac{1}{8}$ and $\frac{1}{2}$ inch. However, it is preferred that the lateral spacing between the bottom of each skirt 40 and 41 and its adjacent lateral side 34 and 36 of the body 12 and its adjacent lateral edge of the abrasive 16 be at least about 1/16 inch but not greater than about $\frac{1}{4}$ inch.

The sander body 12, handle 18, vacuum connector 28, skirts 40 and 41, bracket 42 and hinge 44 can be made of any conventional tough rigid materials, such as wood, plastic or metal. However, a rigid plastic material, such as a polyethylene, polypropylene or polymethacrylate, is preferred for the body, vacuum connector, bracket and hinge. Each skirt 40 and 41 is preferably made of a flexible material, such as a natural or synthetic, soft rubber which will not scratch the surface of an object being abraded and will not be substantially deformed laterally toward the ports 32 by the differential air pressure on opposite lateral sides of each skirt 40 and 41.

In operation, the sander 10 can be used to abrade a surface of an object while the dust generated thereby is removed, so as to maintain a clean and heathly working environment that is substantially free of air-borne dust. The vacuum connector 28 can be connected to the hose of a conventional household vacuum cleaner (not shown). Then, the sander handle 18 can be grasped by one or both hands of the user and moved longitudinally so that the abrasive 16 on the bottom 14 of the sander body 12 is urged against the surface of the object so as to abrade the surface. As dust is generated by moving the sander 10 back and forth on the object's surface, the dust does not remain on the surface or fail to the ground but instead is sucked upwardly into the space between each skirt 40 and 41 and its adjacent lateral side 34 and 36 of the sander body 12. From there, the dust is sucked through the ports 32, the channels 38, the cavity 30 and the vacuum connector 28 and into the vacuum cleaner. If desired, the skirt 40, hingedly connected to the sander body 12, can be moved upwardly away from its adjacent lateral side 34, as shown in FIG. 4, so that the skirt 40 extends upwardly from the hinge 44 in a position where the skirt 40 does not cover any ports 32 and cannot interfere with the use of the sander 10 for abrading surface areas of the object adjacent to obstructions on its surface. Most of the dust generated while the skirt 40 extends upwardly will still be picked up by the ports 32 on the opposite lateral sides 34 and 36 of the sander body 12.

It is thought that this invention and many of its attendant advantages will be understood from the foregoing description, and it will be apparent that various modifications and changes can be made in the invention without departing from the spirit and scopre thereof or sacrificing all of its material advantages, the block sander 10 herein before described being merely a preferred embodiment. In this regard, terms such as "longitudinal", "lateral", "top", "bottom", "front", "rear", "above", "below" and "downwardly" are used herein simply as relative terms to describe the sander 10 as shown in FIGS. 1–4 and as claimed hereinafter. Moreover, the longitudinally extending central cavity 30 and the laterally extending channels 38 can, if desired, be combined, for example in the form of a plurality of laterally and longitudinally extending passages within the sander body 12, connecting the ports 32 with the vacuum connector 28. Also, the separate skirts 40 and 41 can, if desired, be combined as a single skirt wrapped about the front, rear and lateral sides 24, 26, 34 and 36 of the sander body 12 if it is not desired that one or both of the skirts 40 and 41 be movable upwardly away from their adjacent lateral side 34 and 36, respectively. Furthermore, both of the separate skirts 40 and 41 can, if desired, be hingedly connected to the sander body 12, for example, by means of separate longitudinally extending hinges 44. In addition, some or all of the ports 32 in each lateral side 34 and 36 can, if desired, be located so that they are not in a longitudinally extending row, with the bottom of each port adjacent to the bottom of the body 12.

I claim:

1. A hand-powered abrading device comprising:

a substantially rigid body having a substantially planar bottom and a plurality of ports in a first lateral side thereof;

abrading means on the bottom of the body;

handle means on top of the body for holding the body and moving it longitudinally to abrade an object beneath the body in contact with the abrading means;

passage means extending laterally and longitudinally through the body and adapted to connect the ports to a source of vacuum; and a first depending skirt connected to the body above the ports in the first lateral side and extending longitudinally along, and adjacent to, the first lateral side of the body and the ports therein; the first skirt: (a) substantially covering the ports in the first lateral side, (b) being spaced laterally away from the first lateral side and the ports therein, and (c) extending downwardly beneath the ports to at least about the bottom of the body.

2. The device of claim 1, wherein the first skirt is a flexible skirt.

3. The device of claim 2, wherein a plurality of the ports are provided in a second lateral side of the body, which is on a laterally opposite side of the body from the first lateral side.

4. The device of claim 3, wherein a separate second depending skirt is provided adjacent the second lateral side of the body; and wherein the second skirt substantially covers the ports in the second lateral side.

5. The device of claim 4, wherein at least one of the skirts is hingedly connected to the body.

6. The device of claim 5, wherein each skirt is mounted on top of the body by means extending longitudinally along substantially the entire length of its adjacent lateral side of the body.

7. The device of claim 4, wherein only two opposite lateral sides of the body are provided with the ports and with a separate skirt adjacent to each lateral side.

8. The device of claim 1, wherein the ports are circular and are arranged in a longitudinally extending row in the first lateral side.

9. The device of claim 8, wherein the bottom of each port is adjacent to the bottom of the body.

10. The device of claim 9, wherein the bottom of each port is substantially tangential to the bottom of the body.

11. The device of claim 10, wherein the first skirt extends downwardly beneath the bottom of the body but not beneath the abrading means.

* * * * *